US011255144B2

(12) United States Patent
Hughes

(10) Patent No.: US 11,255,144 B2
(45) Date of Patent: Feb. 22, 2022

(54) ANNULAR PRESSURE CAP DRILLING METHOD

(71) Applicant: Hughes Tool Company LLC, Highlands Ranch, CO (US)

(72) Inventor: William James Hughes, Highlands Ranch, CO (US)

(73) Assignee: HUGHES TOOL COMPANY LLC, Highlands Ranch, CO (US)

( * ) Notice: Subject to any disclaimer, the term of this patent is extended or adjusted under 35 U.S.C. 154(b) by 0 days.

(21) Appl. No.: 17/113,005

(22) Filed: Dec. 5, 2020

(65) Prior Publication Data

US 2021/0172273 A1 Jun. 10, 2021

Related U.S. Application Data

(60) Provisional application No. 62/945,210, filed on Dec. 8, 2019.

(51) Int. Cl.

| | |
|---|---|
| ***E21B 21/08*** | (2006.01) |
| ***E21B 33/047*** | (2006.01) |
| ***E21B 34/02*** | (2006.01) |

(52) U.S. Cl.

CPC ..... *E21B 21/08* (2013.01); *E21B 33/047* (2013.01); *E21B 34/025* (2020.05)

(58) Field of Classification Search

CPC ..... E21B 21/08; E21B 33/047; E21B 34/025

See application file for complete search history.

(56) References Cited

U.S. PATENT DOCUMENTS

| | | | | |
|---|---|---|---|---|
| 1,569,247 | A | 4/1922 | Abercrombie et al. | |
| 5,720,356 | A | 2/1998 | Gardes | |
| 6,367,566 | B1 * | 4/2002 | Hill | E21B 43/26 175/57 |
| 6,732,804 | B2 * | 5/2004 | Hosie | E21B 33/03 166/373 |
| 7,185,718 | B2 * | 3/2007 | Gardes | E21B 21/14 175/62 |
| 7,743,823 | B2 | 6/2010 | Hughes et al. | |

(Continued)

OTHER PUBLICATIONS

PCT International Search Report for International Application PCT/US2020/063522, dated Apr. 29, 2020 (dated Apr. 29, 2020).

(Continued)

*Primary Examiner* — Matthew R Buck

(57) ABSTRACT

Disclosed herein are various embodiments of methods and systems for drilling an oil or gas well safely and efficiently using underbalanced or near-balanced drilling techniques, wherein the primary means of pressure control is a Annular Pressure Control Diverter positioned below the BOP stack, with a return flow pattern where no drilling fluid returns up the (traditional) annulus between the drill pipe and the production casing and instead drilling fluid returns up the annulus between the production casing and intermediate casing. Drilling fluid returns flow through a wellhead, instead of a flow spool conventionally located below an upper RCD, and hence to the drilling choke. This drilling approach eliminates the need for hydraulic fracturing and preserves the natural fracture system of the producing formation while providing additional safety measures. It also prevents the accidental or deliberate discharge or flaring of methane during drilling and production.

15 Claims, 6 Drawing Sheets

(56) References Cited

U.S. PATENT DOCUMENTS

| | | | | |
|---|---|---|---|---|
| 8,028,750 | B2 | 4/2011 | Hughes et al. | |
| 9,200,493 | B1 * | 12/2015 | Lugo | E21B 29/02 |
| 9,540,898 | B2 | 1/2017 | Hughes et al. | |
| 9,976,375 | B2 * | 5/2018 | Kotrla | E21B 41/0007 |
| 10,260,288 | B2 * | 4/2019 | Shafer | E21B 43/0122 |
| 2003/0217849 | A1 | 11/2003 | Hosie et al. | |
| 2008/0060846 | A1 | 3/2008 | Belcher et al. | |
| 2009/0236144 | A1 | 9/2009 | Todd et al. | |
| 2016/0053542 | A1 | 2/2016 | Stafford | |

OTHER PUBLICATIONS

Blowout Preventer' Wikipedia. Jan. 28, 2021 (2021) [online] [retrieved on Jan. 31, 2021] Retrieved from the Internet: <URL: https://en.wikipedia.org/wiki/Blowout_preventer>.

* cited by examiner

ANNULAR PRESSURE CAP DRILLING METHOD

CROSS REFERENCE TO RELATED APPLICATIONS

This application claims the benefit of U.S. Provisional Patent Application No. 62/945,210, entitled "Annular Pressure Cap Drilling System and Method" to William James Hughes, filed on Dec. 8, 2019, which is hereby incorporated by reference in its entirety.

This application is related to U.S. Provisional Patent Application No. 63/051,837, entitled "Annular Pressure Control Diverter" to William James Hughes, filed on Jul. 14, 2020, which is hereby incorporated by reference in its entirety.

This application is related to U.S. Provisional Patent Application No. 63/082,059, entitled "Annular Pressure Control Ram Diverter" to William James Hughes, filed on Sep. 23, 2020, which is hereby incorporated by reference in its entirety.

FIELD

Various embodiments described herein relate to drilling oil and gas wells and devices, systems, and methods associated therewith.

BACKGROUND

The following descriptions and examples are not admitted to be prior art by virtue of their inclusion within this section.

When conventional drilling methods are used to drill for oil and gas, precautions must be taken to avoid "blowouts", that is, the dangerous condition where the drill bit encounters a subsurface formation containing hydrocarbons under high pressure. In the early days of drilling for oil and gas, not only could a blowout send large amounts of oil or gas to the surface, the entire rig would sometimes catch fire. The industry quickly developed drilling methods which prevented this type of disaster and devices to increase safety and efficiency.

When the first commercial oil wells were drilled, they were drilled to relatively shallow depths using cable tools which mechanically removed cuttings from the wellbore. Even in these shallow wells, the operators sometimes encountered high pressure oil or gas pockets, resulting in dangerous and wasteful blowouts as the hydrocarbons escaped up the wellbore. Rotary drilling was introduced in the early 1900s and is disclosed, for example, in U.S. Pat. No. 930,758 to H. R. Hughes, entitled "Drill". The original Hughes Tool Company's roller cone bit design forever changed how the oil and gas industry drilled wells. More specifically, the rotary drill bit allowed much deeper wells to be drilled, which meant the pressures encountered rose rapidly. Rotary drilling requires the circulation of drilling fluid down the drill pipe and back up the annulus between the pipe and the casing to lubricate and cool the drill bit and to remove the cuttings from the bottom of the well.

For many years the industry standard practice has been to use heavy drilling mud as the primary means of controlling pressure in the well. The density of the drilling mud is adjusted so that the weight of the column of mud in the wellbore exerts a pressure on the rock formation being drilled which exceeds the predicted pressure of any hydrocarbons contained within the formation. This technique is very effective in preventing blowouts caused by hitting high-pressure zones of oil or gas. The drilling mud also lubricates the drill bit and helps to remove the rock cuttings created by the drilling process.

As the well was drilled deeper, different formations with different fluid pressures would be encountered. It is the responsibility of a "mud engineer" to constantly adjust the density of the drilling fluid. If the fluid was too light, blowouts could occur, but if it was too heavy, the cuttings would not efficiently be removed from the area in front of the drill bit and thus the rate of drilling would slow.

The standard practice is not entirely risk-free. The mud engineer responsible for adjusting the density and total mud weight must constantly monitor the process, and mistakes can be made, resulting in blowouts. Therefore, additional protection is provided for the workers on the rig floor by installing various mechanical barriers to prevent the sudden and dangerous release of hydrocarbons under high pressure.

For example, in addition to using heavy drilling mud, mechanical barriers are often commonly employed. Those of ordinary skill in the art will appreciate the use of blowout preventers ("BOPs"), such as various types of hydraulic rams which can be closed to seal off a wellbore annulus, diverters configured to direct high-pressure flow away from the rig, and others. U.S. Pat. No. 1,569,247 to Abercrombie et al., entitled "Blow-out Preventer", describes an early version of one of these devices. Several BOP devices are usually installed above a wellhead in what is referred to as a "stack" or a "BOP stack". A typical stack consists of between one and six ram-type blowout preventers and one or two annular blowout preventers. Some of these devices are routinely employed when performing normal drilling operations, such as changing a drill bit. Others are used in emergencies, as a last resort, to prevent accidents and disasters.

It has been said that Howard Hughes not only invented the rotary drill bit, he inadvertently created formation damage. That may be giving too much credit to Howard Hughes, but it remains true that the goal of drilling operations which rely on heavy drilling mud seems to have been to inflict the maximum possible formation damage and prevent the release of any hydrocarbons whatsoever. More specifically, as those of ordinary skill in the art will appreciate, mud forced into a wellbore at high pressure will invade and plug formation pores and natural fractures. The capillary action of the pores and fractures exacerbates this issue, reducing the effective formation permeability to zero. Thus, heavy drilling mud prevents hydrocarbons from entering the wellbore and reaching the surface.

The use of heavy drilling mud is referred to as "overbalanced" drilling, because the weight of the drilling fluid in the wellbore intentionally exceeds the pressures expected to be encountered in the well. This is not a problem while drilling through non-producing formations on the way to a target production zone. From the driller's perspective, it is still not a problem even when the target zone is encountered.

Completion engineers understandably have a different point of view. The problem is that the drilling fluid barrier is equally effective when drilling is complete and the well is turned over to the completion engineers. The completion engineer always tries to achieve the maximum possible flow of hydrocarbons, which requires the least possible formation damage and the maximum possible uncontaminated porosity and permeability. These goals are hard to accomplish when the pores and natural fractures have been plugged by drilling fluid. The proposed solution commonly employed by many completion engineers is hydraulic fracturing, referred to as "fracing" within the oil and gas industry and "tracking" in the popular media. Fracing is often said to be necessary to fracture rocks which have few natural fractures. The reality is that all rocks contain natural fractures, some more than others. Industry insiders will admit, when pressed, that fracing is frequently employed in an attempt to blast through a damaged portion of the producing formation and restore a path for the hydrocarbons to flow through.

Hydraulic fracturing involves pumping fluid under very high pressure into hydrocarbon-bearing rock formations to force open cracks and fissures and allow the hydrocarbons residing therein to flow more freely. The fluid is primarily water, and may contain chemicals to improve flow, and "proppants" (an industry term for substances such as sand). In theory, when the fracturing fluid is removed and the hydrocarbons are allowed to flow, the sand grains prop open the fractures and prevent their collapse, which would otherwise quickly stop or reduce the flow of hydrocarbons. However, many rock types react with water and expand, further reducing the possibility of producing hydrocarbons. Yet, the industry continues to use water for hydraulic fracturing operations in shale formations.

For the first 100 years and more of oil exploration and production, wells were drilled almost exclusively in geologic formations which permitted the production of oil and gas flowing under the natural pressures associated with the formations. Such production required that two physical properties of the geologic formation fall within certain boundaries. The porosity of the formation had to be sufficient to allow a substantial reserve of hydrocarbons to occupy the interstices of the formation, and the permeability of the formation had to be sufficiently high that the hydrocarbons could move from a region of high pressure to a region of lower pressure, such as when hydrocarbons are extracted from a formation. Many of these reservoirs had sufficient porosity and permeability to allow the flow of hydrocarbons even after the damage inflicted by overbalanced drilling.

In recent years, it has become apparent that large reserves of hydrocarbons are to be found in shale formations. The current mindset in the upstream oil and gas industry is that unconventional reservoirs such as shales need to be hydraulically fractured because they are "tight". This premise is contradicted by shale reservoirs such as the Monterey in California, the Pierre in Colorado and the Marcellus in New York which were very productive in the early 1900's, long before hydraulic fracturing was invented. These reservoirs were drilled without overbalanced mud systems, and even though they were vertical wells, they still encountered a small fraction of the formation's natural fracture system. Tectonically induced natural fractures initially propagate perpendicular to the bedding plane of a formation. Over time, sedimentary beds with no dip can be tilted, thereby tilting the natural fracture system within the formation so that even a vertical well can intersect a few natural fractures. Given the high dip of many formations in California, vertical wells are technically high angle wells based on the definition of a horizontal well, which is a wellbore drilled parallel to the bedding plane of a formation and not a wellbore drilled parallel to the surface of the earth.

Many early Monterey Shale wells exceeded 10,000 barrels of oil per day ("BOPD") without fracing. This does not fit with the current doctrine that shales are too tight to produce without fracing. When most industry professionals talk about a shale reservoir being "tight" they are generally referring to the matrix, which is a correct observation. What is not considered, however, is the permeability contribution from natural micro and macro fractures which exist in all hard (brittle) sedimentary rocks such as shales. Determination of the "collective" permeability system is important to understanding why so-called "tight" rocks can produce without being hydraulically fractured. It should be noted that a single natural fracture with an aperture of 25 microns has over 50 darcys of permeability.

In the last thirty years drilling technology has evolved to allow wells to be drilled in virtually any direction, i.e., drilling is no longer constrained to vertical wells. Deviated wells are thus often drilled horizontally along specific geologic formations to increase production potential. The extent of a hydrocarbon-producing formation in a vertical well may be measured in feet, or perhaps tens or hundreds of feet in highly productive areas. By drilling horizontally or non-vertically through a formation, the extent of the formation in contact with the wellbore can be much greater than is possible with vertically-drilled wells. Natural fractures tend to propagate in the direction of maximum stress. In formations which are essentially horizontal, the fractures tend to occur in the vertical direction. Thus a horizontal well intersects the maximum number of fractures for a given distance drilled. In order to optimize production and the useful life of the well, the natural fracture system should not be compromised by the injection of heavy drilling fluids.

A newer and better approach is to not cause formation damage in the productive formation in the first place. Some drilling operations are conducted using "underbalanced" or "near balanced" drilling techniques to avoid formation damage. In underbalanced drilling ("UBD"), a light drilling fluid, such as mineral oil, is used. The weight of the column of drilling fluid is then significantly less than the expected pressures which may be encountered during drilling. In near balanced reservoir drilling ("NBRD"), the weight of the column of drilling fluid may approach, but is never allowed to exceed, the pressures of the hydrocarbons in the target formations.

Some wells are drilled using overbalanced techniques for the vertical section of the well. Then as the horizontal sections are drilled out from the vertical wellbore, the heavy drilling mud is no longer used, and underbalanced or near balanced drilling is used while drilling through the producing formation. This approach has not gained wide acceptance, in part because of reluctance to adopt new technique, and in part because of safety concerns.

The primary difference between traditional underbalanced drilling and near balanced drilling is that traditional underbalanced drilling is overbalanced in front of the drill bit. The near balanced method is underbalanced in front of the bit because the drilling technique allows no drilling fluid to exit the drill bit. Both of these approaches avoid formation damage and do not force drilling fluid into the pores and fractures of the formation. Both techniques expect, and plan for, the production of hydrocarbons while drilling the well.

UBD and NBRD techniques differ from "Managed Pressure Drilling" ("MPD"), where the weight of the column of drilling fluid is adjusted to minimize formation damage, but is kept high enough that no hydrocarbons are produced during drilling. Therefore there will inevitably be some degree of formation damage when using MPD techniques.

Because underbalanced techniques do not rely on heavy drilling mud, an additional pressure barrier must be positioned between the drilling rig crew and the high pressures downhole. That is, employing underbalanced drilling techniques creates a potential hazard and other safety devices are needed to provide continuous control of the pressure in the well while drilling. In addition, the devices must be capable of functioning while the drill pipe is present, and more significantly, while the drill pipe is rotating. The safety device must also be capable of sealing off the annulus around the rotating drill pipe with pressures in the well of 1,500 psi and above.

The sealing element in a conventional annular BOP often wears out from the friction the rotating drill pipe generates. Distortion of the seal due to the torque transferred from the drill pipe also often compromises seal effectiveness. Additional wear and damage often occurs when tripping the drill string. No drilling engineer would allow such wear on a secondary or backup safety device, which has to work reliably when needed during well control events, and seal off high pressures in an emergency. There is therefore no question that the annular BOP cannot be used as a substitute for the primary safety barrier of the drilling mud.

The industry, therefore, developed the Rotating Control Device ("RCD), which also operates to close off the annulus around the drill pipe, but is intended to operate while drilling operations are in progress, that is, while the drill pipe is rotating. Commonly, a rotating control device (RCD) is installed at the top of the BOP stack. RCD examples are disclosed in U.S. Pat. Nos. 7,743,823, 8,028,750, and 9,540,898, which are incorporated by reference herein. The internal sealing element of an RCD which grips the drill pipe rotates with the drill pipe. While that solves the problem of wear on the inside diameter of the sealing element, the element must be supported on bearings installed below, and sometimes above, the sealing element to aid in the rotation and prevent the element from wearing out. Unfortunately, this creates additional problems because the bearings wear out and must be replaced periodically. Using an RCD at the top of the BOP stack is not an ideal solution as the drillers and rig crew must often operate near pressures above 5,000 psi. Therefore, safely adopting underbalanced and near balanced drilling techniques requires an alternative primary pressure barrier to prevent blowouts and to reduce the danger to the rig workers from highly pressurized rig equipment.

Thus, it is a long-felt need to provide improved drilling techniques which do not damage rock formations during the drilling process. These improved techniques will allow hydrocarbon production from the natural fracture systems in the rocks without the need for hydraulic fracturing. Such improved techniques will also remove the need for the millions of gallons of water, the sand, and the chemicals required by fracing operations. The improved techniques also offer a level of safety which is at least as good as, and is preferably better than, that provided by traditional drilling techniques.

SUMMARY

It is one aspect of some embodiments of the present invention to provide a method for drilling an oil or gas well using a mechanical primary pressure control mechanism, comprising installing an Annular Pressure Control Diverter between a conventional blowout preventer (BOP) equipment stack and a wellhead or casing head as the mechanical primary well pressure control mechanism It is another aspect of some embodiments of the present invention to provide a method for drilling an oil or gas well using a mechanical primary pressure control mechanism, comprising: providing a tubing head; interconnecting a production casing head to the tubing head; interconnecting a casing head to the production casing head; interconnecting a production casing on a first end to the production casing head and to a second end to a bottom hole drilling assembly; interconnecting an intermediate casing to the casing head, wherein the intermediate casing is positioned about the production casing to provide an outer annulus, the intermediate casing also interconnected to the production casing with a liner hanger and interconnecting an inner tubing string configured to transport drilling fluid on a first end to an annular pressure control diverter and to a second end to the bottom hole drilling assembly, wherein portions of the inner tubing string extends through the tubing head, the production casing head, and the casing head and wherein the inner tubing string is positioned within the production casing to define an inner annulus and wherein the annular pressure control diverter is the mechanical primary pressure control mechanism of the oil and gas well.

It is another aspect of some embodiments of the present invention to provide a method for drilling an oil or gas well having a return flow pattern where no fluids return up an annulus between an inner tubing string and a production casing, wherein drilling fluid alternatively returns up an annulus between the production casing and an intermediate casing, comprising: installing a blowout preventer, the blowout preventer being in fluidic communication with the casing head; installing the intermediate casing to the casing head; installing a flow line from the casing head to a production separator; installing the production casing concentric with and inside the intermediate casing; installing the inner tubing string concentric and inside the production casing; wherein the production casing is ported above a lower extremity of the intermediate casing to enable the return flow of fluids from the annulus between the inner tubing string and the production casing, into the annulus between the production casing and the intermediate casing, to the casing head, and to the separator; and installing an Annular Pressure Control Diverter between the blowout preventer and the casing head, the Annular Pressure Control Diverter as a mechanical primary pressure control mechanism configured to selectively block the annulus between the inner tubing string and the production casing to create a return flow pattern where no drilling fluid and produced fluids return up the annulus between the inner tubing string and the production casing and instead drilling fluid and produced fluids return up the annulus between the production casing and the intermediate casing.

It is another aspect of some embodiments of the present invention to provide a method for drilling an oil or gas well wherein drilling fluid returns are flowed through a well head located below an all-inclusive blowout preventer stack to a drilling choke, comprising: installing an intermediate casing attached to a casing head; installing a production casing concentric with and inside the intermediate casing; installing a flow line from a production casing head to a separator; inserting an inner tubing string concentric with and inside the production casing; wherein the production casing is ported above a lower extremity of the intermediate casing to enable the return flow of fluids from an annulus between the inner tubing string and the production casing into an annulus between the production casing and the intermediate casing, to the production casing head, and to the drilling choke and installing an Annular Pressure Control Diverter as a mechanical primary pressure control mechanism below the blowout preventer stack, the Annular Pressure Control Diverter configured to selectively block the annulus between the inner tubing string and the production casing.

Further embodiments are disclosed herein or will become apparent to those skilled in the art after having read and understood the specification and drawings hereof.

BRIEF DESCRIPTION OF THE DRAWINGS

Different aspects of the various embodiments of the invention will become apparent from the following specification, drawings and claims in which:

The drawings are not necessarily to scale. Like numbers refer to like parts or steps throughout the drawings.

DETAILED DESCRIPTION OF SOME EMBODIMENTS

Figure 1B:
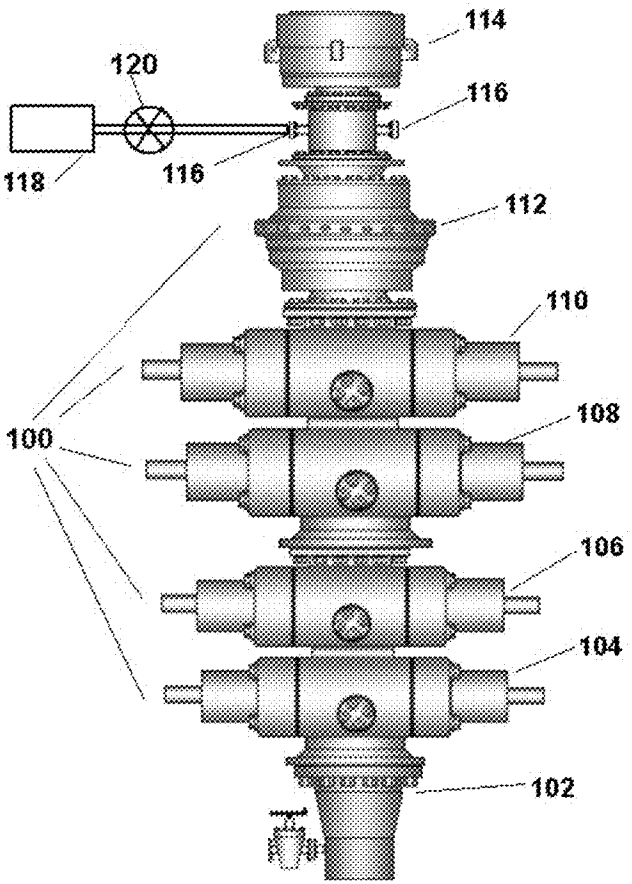
FIG. 1B shows a conventional blowout preventer stack configured for underbalanced drilling operations with a rotating control device at the top of the stack.

In the following description, specific details are provided to impart a thorough understanding of the various embodiments of the invention. Upon having read and understood the specification, claims and drawings hereof, however, those skilled in the art will understand that some embodiments of the invention may be practiced without hewing to some of the specific details set forth herein. Moreover, to avoid obscuring the invention, some well-known methods, processes and devices and systems finding application in the various embodiments described herein are not disclosed in detail.

Referring now to the drawings, embodiments of the present invention will be described. The invention can be implemented in numerous ways. Several embodiments of the present invention are discussed below. The appended drawings illustrate only typical embodiments of the present invention and therefore are not to be considered limiting of its scope and breadth. In the drawings, some, but not all, possible embodiments are illustrated, and further may not be shown to scale.

The oil and gas industry has standards for the size of pipes and casings, and for the sizes and configurations of devices such as casing heads, blowout preventers, chokes, etc. Therefore when this specification describes such devices as being installed, one of ordinary skill in the art will understand that the devices are installed and connected using industry standard connections.

Embodiments of the present invention, the Annular Pressure Cap Drilling Method, are directed to an alternative primary pressure barrier referred to as an Annular Pressure Control Diverter. Embodiments of the present invention are not a standard annular blowout preventer (BOP), nor are they conventional rotating control device (RCD). The contemplated devices, apparatus, and systems may perform some functions of a BOP or RCD, but the contemplated devices are intended to be used in a different manner while drilling. To fully appreciate the embodiments of the present invention, it is helpful first to discuss the different types of BOPs, annular BOPs and RCDs and how they are used.

Figure 1A:
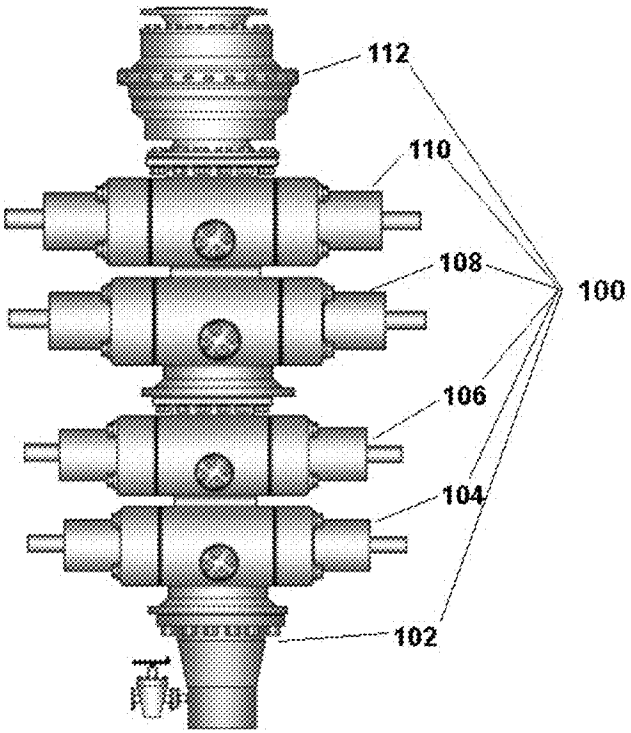
FIG. 1A shows a conventional blowout preventer stack.

A typical BOP stack configuration for an overbalanced drilling operation is shown in FIG. 1A. Here the BOP stack 100 is positioned above the wellhead 102. During drilling operations, hydraulic ram blowout preventers may be used to close off the well for maintenance purposes, tripping the drill bit, or in case of problems. Ram-type blowout preventers can only be used when drilling operations are not in progress and the drill pipe is not rotating or is not present. A shear ram 104 may also be installed and used to cut through the drill pipe, obviously only in emergencies or in certain specific situations. One or more blind rams 106 are also installed in the stack to completely close the wellbore when no pipe is present. Pipe rams 108 and 110 close the annulus around the drill pipe and are also used when the drill pipe is present in the well. An annular BOP 112 is, as the name implies, intended to close off the annulus around the drill pipe and is intended to be used when the drill pipe is present but not rotating.

As shown in FIG. 1B, the RCD 114 is installed at the top of the BOP stack 100. Returned drilling fluid and produced hydrocarbons flow up through the BOP stack 100 and are blocked at the top of the BOP stack 100 by the RCD 114. The flow is diverted out through a flow spool 116 and separator 118, where the drilling fluid and produced hydrocarbons and water are separated. The pressure in the BOP stack can be regulated by adjusting the drilling choke 120.

As described above, while drilling is in progress, the ram BOPs 104-110 and annular BOP 112 are not activated. Therefore the pressure of the fluids in the wellbore is held in check only by the RCD 114 and the drilling choke 120, which exposes the operators on the rig floor to very high pressures with only the single RCD 114 between them and potential disaster. RCD 114 location at the top of the stack is dictated by the need to periodically replace the bearings for the sealing elements, which requires removal of a top portion of the RCD 114.

The returning fluid contains cuttings from the drilling which must be removed so that the drilling fluid can be recirculated. It will be obvious to a person of ordinary skill in the art that as the return fluid flows up through the BOP stack 100, the internal mechanisms of the rams 104, 106, 108, 110 and annular BOP 112 will trap and accumulate these cuttings from the continuous return fluid flow. When the need arises to activate the BOP devices, this buildup of detritus in their internal cavities may be an impediment to their proper operation.

A further disadvantage of this approach is seen when the BOP stack devices are activated. If one of the devices below the RCD is activated, and then the pressure in the well drops, there will be a pocket of high pressure fluid in the BOP stack between the two activated devices. If multiple devices are activated, there may be several zones with different pressures. While this is not an insurmountable problem, care must be taken when returning to normal operations. In particular, the order in which the devices are deactivated is important, to avoid a sudden and damaging release of pressure in one of these pockets.

Many of these disadvantages of a conventional underbalanced drilling operation are addressed and overcome by the proposed drilling approach, the Annular Pressure Cap Drilling Method, described herein. The Annular Pressure Cap Drilling Method is based on the premise that the well pressure should not be controlled at the top of the BOP stack as is done with the RCD 114 in FIG. 1B. In addition, the primary pressure control mechanism in conventional drilling, the mud system, is not employed. The substitute for the primary safety and control system should take its place, that is, below the BOP stack 100. The components of the BOP stack 100 can then function as intended, as a secondary safety and control system.

The methods and techniques described below are intended to be used in "underbalanced" or "near balanced" drilling. In underbalanced drilling, a light drilling fluid, such as mineral oil, is used. The weight of the column of drilling fluid is then far less than the expected pressures which may be encountered during drilling. In near balanced drilling, the weight of the drilling fluid may approach, but is never allowed to exceed, the pressures of the hydrocarbons in the target formations. Both of these approaches avoid formation damage and do not force drilling fluid into the pores and fractures of the formation.

In some embodiments the Annular Pressure Cap Drilling Method for near balanced reservoir drilling uses an Annular Pressure Control Diverter, a device designed specifically to be positioned below the conventional BOP stack and function as the primary pressure barrier. The contemplated method is contrary to conventional practice, where the annular devices, such as BOPs and RCDs, are only placed at the top of the BOP stack. The devices at the top of the BOP stack continue to serve their usual function as secondary blowout prevention devices. Substituting a mechanical barrier for the mud system greatly reduces the risk of errors, and provides a reliable system for controlling pressure which is tested on a regular schedule.

Figure 2:
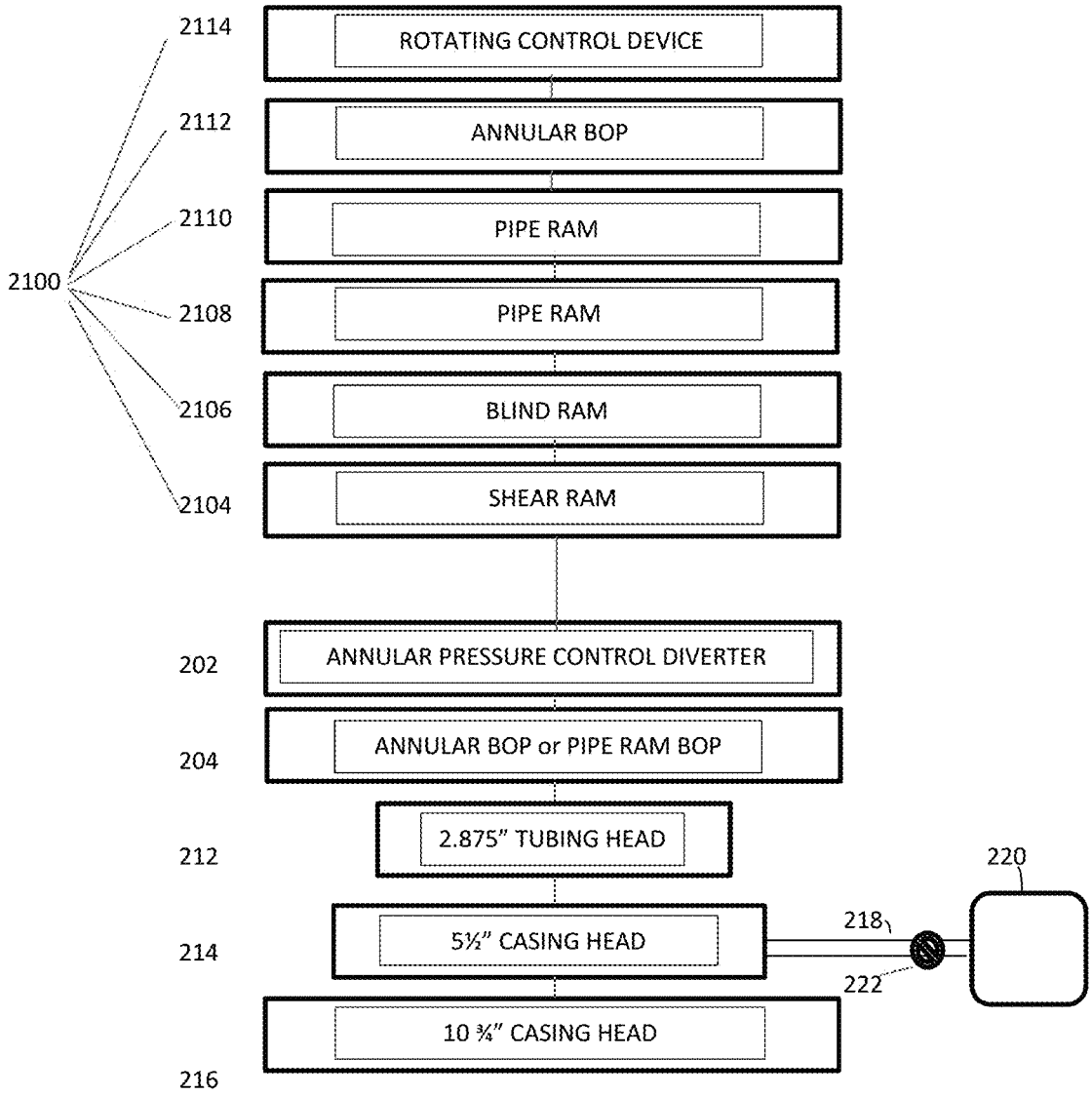
FIG. 2 shows a conceptual diagram illustrating the addition of an Annular Pressure Control Diverter of one embodiment as the primary pressure barrier below the conventional blowout preventer stack.

One possible embodiment showing the use of an Annular Pressure Control Diverter as a primary pressure barrier is illustrated in FIG. 2. For clarity, the various components are shown as rectangles. There are many components from multiple different suppliers which can be used in this method, so FIG. 2 avoids the use of detailed depictions of specific components in order to not show an implied preference for one variation of a component over another.

In FIG. 2, components 2100 through 2114 are the same as components 100 through 114 previously described and shown in FIG. 1. This set of components, which in conventional drilling is referred to as "the BOP stack", 2100, will be referred to in the following description as "the upper BOP stack".

In FIG. 2, the device employed as a primary pressure barrier is an Annular Pressure Control Diverter 202. Below the Annular Pressure Control Diverter 202 is an annular BOP or pipe ram BOP 204. An annular BOP may not always be present, but may be required in order to comply with safety regulations concerning BOP stacks written for conventional drilling techniques. At this location, a pipe ram BOP is used in its normal role as a safety device and for maintenance and other routine operations during drilling. This entire Lower BOP Stack (202 & 204) is supported on the wellhead 102. Wellhead 102 includes a casing head 216, which may be 103/4" or 9⅞", a 5½" production casing head 214, and a 2⅞" tubing head 212.

In this and similar embodiments, flow spool 116 and separator 118 are not used. The return fluid flow is handled differently; the pressure and fluid flow are diverted via a flow line 218 to a four-phase separator 220 below ground level, and below the all-inclusive BOP stack 202-204, 2104-2114, while maintaining the underbalanced condition using a valve 222 to bleed off the excess pressure.

It must be emphasized that there will be no pressure on the upper BOP stack while drilling using the embodiments described herein and all pressure will be contained below the Annular Pressure Control Diverter 202. The present invention brings an additional increase in the safety of the drilling operation, as the Annular Pressure Control Diverter 202 is positioned below the rig floor. The drilling personnel are thus not working close to high pressure equipment.

The In some embodiments, the Annular Pressure Control Diverter is similar in concept to an Annular Blowout Preventer or Rotating Control Device. It is important to note the difference between an Annular BOP and a Rotating Control Device. An Annular BOP is designed to be activated only when the drill pipe is not rotating. A RCD is designed to be activated while the drill pipe is rotating. Therefore the seal element in the RCD, which is in contact with the rotating drill pipe, will eventually wear down and must be replaced. If bearings are used to mitigate wear on the seal element, these may need to be replaced. This is not a major problem when the BOP or RCD is at the top of the stack. Most such devices allow the seal element or bearings to be replaced by removing the upper section of the RCD, extracting the worn seal assembly, and sliding a new annular seal assembly down into the RCD. However, this is clearly impractical when the RCD is below the conventional BOP stack. It would be necessary to remove the entire upper BOP stack to gain access to the seal through the top of the RCD.

There are two solutions to this problem. The first may be practical when drilling relatively short lateral wells, for example 2000-3000'. This can be done without changing the RCD seal element or bearings, which will last long enough to safely drill the lateral. Therefore a commercially available RCD may be installed to function as an Annular Pressure Control Diverter 202. It might be possible to use an Annular BOP as an Annular Pressure Control Diverter for drilling a very short lateral, up to a few hundred feet, although these devices are not designed to be used when the drill pipe is rotating and the seal element will wear out rapidly. The use of an Annular BOP for this purpose is therefore not recommended.

The second solution is to use an improved device which comprises side doors, allowing a two-part seal to be removed and replaced without affecting the rest of the BOP stack. Replacing the seal rather than relying on a worn seal to hold adds yet another safety factor to the operation. Such an improved device is the subject of the related U.S. Provisional Patent Application No. 63/051,837, entitled "Annular Pressure Control Diverter" to William James Hughes, hereinafter "the '837 Application", which is hereby incorporated by reference in its entirety.

It should be noted that the word "Annular" in "Annular Pressure Cap Drilling Method" and "Annular Pressure Control Diverter" refers to the use of a device to block the annulus between the drill pipe and the production casing, and not to the internals of the specific devices described in the preceding paragraphs, which compress an annular seal around the drill pipe by applying pressure from below to reduce the internal diameter of the seal. The objective of sealing the annulus and controlling the pressure can also be accomplished using a ram type BOP wherein the seal has been modified to resist torsional forces from rotating drill pipe. Such a device would also provide an annular seal which is compressed, reducing its internal diameter, by applying horizontal pressure from the sides to compress the seal. The ram diverter is the subject of U.S. Provisional Patent Application No. 63/082,059, entitled "Annular Pressure Control Ram Diverter", to William James Hughes, which is hereby incorporated by reference in its entirety.

When using underbalanced or near balanced drilling techniques, hydrocarbons can, and will, flow into the wellbore, as the pressure in the formation exceeds the pressure exerted by the drilling fluid. The operator must be prepared to deal with the flow of oil or gas. With these drilling techniques, it is necessary to plan for oil and gas production, often in significant quantities, during the drilling process. In conventional drilling operations, the returning fluids flow up through the annulus between the drill pipe and the production tubing and then through the BOP stack 100. The fluids are diverted to a separator using a flow spool 116 located below the upper RCD 114. In the current invention, this flow path is impossible because the Annular Pressure Control Diverter 202 blocks the annulus between the drill pipe and the production tubing. Therefore a different path must be provided for the return fluid flow.

Figure 3:
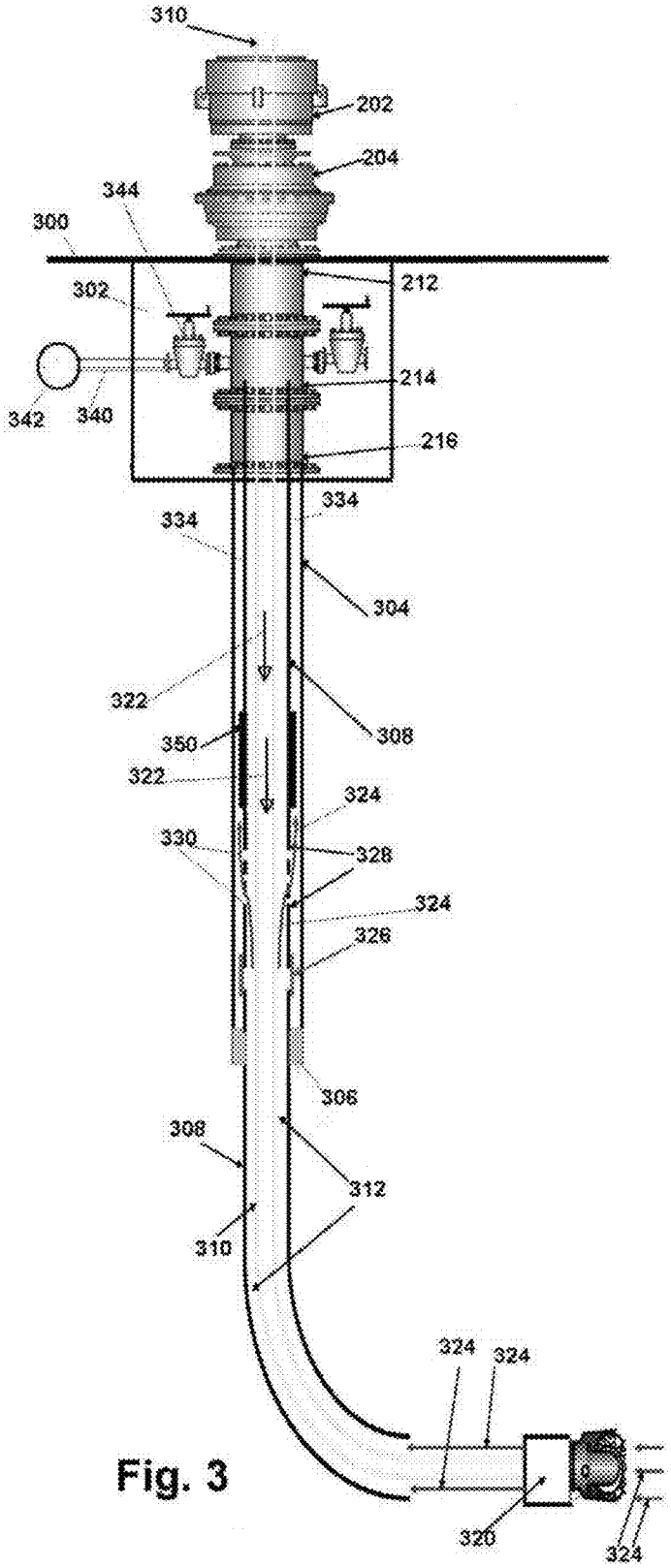
FIG. 3 shows a fluid return flow path when using an Annular Pressure Control Diverter of one embodiment as the primary pressure barrier, wherein drilling fluid returns up the annulus between the production casing and intermediate casing.

FIG. 3 shows how one embodiment of the Annular Pressure cap Drilling Method addresses return flow. Some of the equipment is installed below ground level 300 in what is referred to as a cellar 302. 9⅝" or 103/4" diameter intermediate casing 304 is set and cemented, to a greater depth than is standard in the industry. Intermediate casing 304 may reach as far as 2000-2500' below the wellhead 102 and is supported at the wellhead 102 by a casing head 216. Depending on safety and regulatory requirements, the intermediate casing 304 will usually be enclosed within an outer surface casing which is also cemented.

A liner hanger 306 is installed at the lower extremity of the intermediate casing 304. Production casing 308, having a diameter of 5½" is run inside the intermediate casing 304 and supported at the wellhead 102 by a 5½" production casing head 214. The production casing 308 is cemented into the borehole below the intermediate casing 304. Within the intermediate casing 304, the production casing 308 functions as a tie-back liner, and is not cemented.

Tubing 310, usually having a diameter of 2⅞", which functions as drill pipe while drilling, is positioned inside the production casing 308 and is supported at the wellhead on a 2⅞" tubing head 212. The tubing 310 is the actual drill pipe to which the bottom hole drilling assembly 320 is attached. Drilling fluid 322 is pumped down the tubing 310, and returns up the annulus 312 between the tubing 310 and the production casing 308.

The Annular Pressure Control Diverter 202 referred to previously is installed above the tubing head 212, such that the tubing 310 runs through the seals of the Annular Pressure Control Diverter 202. The Annular Pressure Control Diverter 202 therefore blocks the annulus 312 between the tubing 310 and the production casing 308. The return flow of fluid 324, which includes the drilling fluid and cuttings, and may include produced hydrocarbons, cannot enter the upper BOP stack 2100. Therefore an alternate path must be provided for the return flow of fluid 324.

In one embodiment of the present invention, a tie-back receptacle 326 is installed above the liner hanger 306. A section 328 of the production casing 308 above and proximate to the tie-back receptacle 326 is ported. This section 328 of the production casing is referred to as a "ported sub". The ports 330 allow the return flow of fluid 324 up the annulus 312 between the tubing 310 and the production casing 308, through the ports 330, and into the annulus 334 between the production casing 308 and intermediate casing 304. When the flow reaches the casing head 214, it is diverted along a flow line 340 to a separator 342. The flow is controlled by a valve 344. Here, the cuttings are removed and the drilling fluid is recovered for reuse. Any produced hydrocarbons are sent to a pipeline, or a storage tank, or are used on-site to power generators and other equipment. One of ordinary skill in the art, having read this specification, will understand that in embodiments of the present invention no drilling fluid returns up the (traditional) annulus between the tubing 310 and the production casing 308 and instead drilling fluid returns up the annulus 334 between the production casing 308 and intermediate casing 304. Further, fluid returns flow through the wellhead (specifically, casing head 214) instead of a flow spool 116 conventionally located just below the upper RCD 114, the wellhead being located below an all-inclusive BOP stack.

Porting of the production casing is not claimed as an inventive step, as ports have been used in a similar location within the casing configuration. However, previous applications have used the ports 330 to pump fluids down the annulus 334 between the production casing 334 and the tie-back liner and inject these fluids into the annulus 312 between the production casing 308 and the tubing 310 for various purposes. Embodiments of the present invention are distinguished from these prior applications because they use the ports 330 in the opposite direction for the upward return flow of fluid 324, which is not anticipated or suggested by any prior art.

In some embodiments, one or more sub-surface safety valves 350 are installed in the production casing 308 above the ports 330. These sub-surface safety valves 350 are normally open to allow the insertion and rotation of the tubing 310. When the tubing 310 is withdrawn to a position above these sub-surface safety valves 350, the sub-surface safety valves 350 can be closed, completely blocking the production casing 308. The pressure in the well is then held back below the safety valves 350 which temporarily take over as from the Annular Pressure Control Diverter 202 as the primary pressure barrier in the well. This might be done, for example, to allow the seals in the Annular Pressure Control Diverter 202 to be changed. The position of the sub-surface safety valves 350 above the ports 330 means that the return flow of fluid 324 is not affected by the closing of the sub-surface safety valves 350, and production from the well can continue without interruption.

Figure 4:
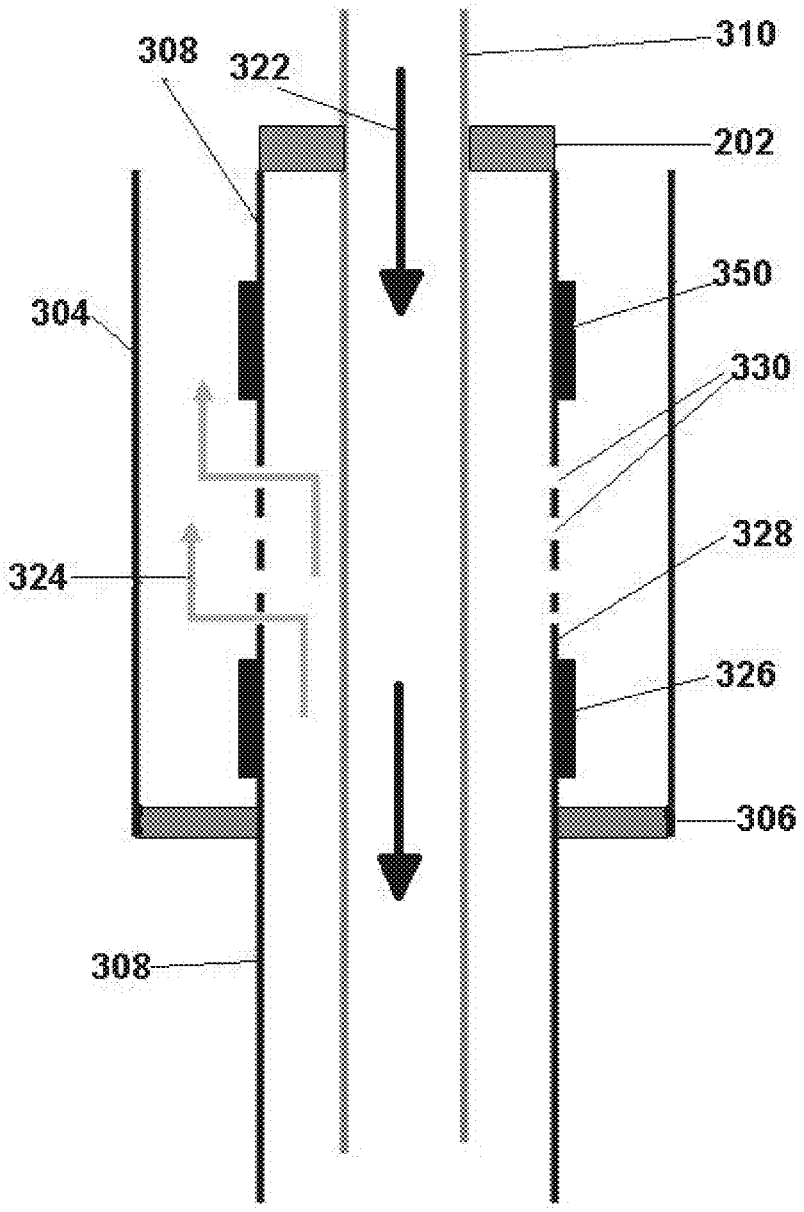
FIG. 4 shows an enlarged view of the fluid return flow path through the ports and annulus when using an Annular Pressure Control Diverter of one embodiment as the primary pressure barrier, wherein drilling fluid returns up the annulus between the production casing and intermediate casing.

FIG. 4 shows an enlarged view of the fluid return flow path through the ports and annulus when using an Annular Pressure Control Diverter as the primary pressure barrier.

In some other embodiments, a continuous string of production casing 308 is installed in the well from the surface wellhead 102 to total depth thus eliminating the subsurface safety valves 350 and tie-back liner and associated junction equipment disclosed in the embodiments disclosed above. Cement is pumped to fill the annulus between the production casing 308 and the wellbore, and would usually terminate at the base of the intermediate casing 304. The cement may in some cases extend above the base of the intermediate casing 304 but still not completely fill the annular space between the two strings of casing, which would allow ports 330 in the production casing 308 to be located anywhere across from the intermediate casing 304 where the annulus 334 between the production casing 308 and the intermediate casing 304 remains open.

An additional environmental benefit of the Annular Pressure Cap Drilling Method is that there will be no venting or accidental discharge of methane, as often happens with conventional drilling. Because the entire philosophy is to allow hydrocarbons to flow while drilling, and the equipment is in place to deal with such flows, there will be no unexpected and sudden flows. Indeed, the point of drilling a horizontal well in a producing formation is that one would expect to produce hydrocarbons, and a lack of such flow would suggest that something is very wrong. Similarly, there is no need for flaring of gas, because the equipment will be in place to either store the oil and gas on site temporarily, use the oil or gas on site, or send these products to a pipeline or a power generation facility. The environmental benefits are significant because methane is 84 times more powerful a greenhouse has than carbon dioxide.

Referring again primarily to FIGS. 2 and 3, one or more pipe rams 206 may also be installed below the Annular Pressure Control Diverter 202. The pipe rams 206 can be closed to block the annulus 312 in order to change the seals on the Annular Pressure Control Diverter 202. They offer an additional safety factor, as they can be closed as needed to block high pressures in the annulus 312. As an additional safety precaution, one or more blind rams 208 and one or more shear rams 210 may also installed below the Annular Pressure Control Diverter 202, and can be activated in an emergency situation. These devices, including the Annular Pressure Control Diverter are referred to as the lower BOP stack.

This drilling approach provides a double level of safety, as it includes two sets of rams and RCDs. The upper set is not normally under pressure, and no fluid normally flows through these devices; therefore there is no internal accumulation of detritus which might interfere with their operation. Although the lower BOP stack is under pressure and is normally filled with drilling fluid, there is no fluid flow through these devices because the flow is diverted through the annulus 334. Therefore detritus from the cuttings will not accumulate in the lower BOP stack.

Embodiments of the present invention also address other problems encountered when using an underbalanced drilling approach with conventional equipment in a conventional configuration. One problem particularly seen in shales is formation damage caused in part by the high clay minerals content known as "fines" which can exceed 25% of the total volume of a shale formation. It is expected that hydrocarbons will be produced while drilling underbalanced. Thus, pressure will increase at the RCD 114 at the top of the conventional BOP stack 100, and the pressure can be, and often is, reduced by opening the drilling choke 120. Opening the drilling choke allows for an increase in the flow of hydrocarbons, and may result in overproduction of the well. The increased flow from the formation causes the migration of fines toward the wellbore, thereby damaging the permeability of the formation proximate to the wellbore.

All too often, the proposed solution to the drop in permeability is hydraulic fracturing. This makes the problem worse because clay fines are well known for swelling when contacted by water, thus blocking permeability even further.

In the present invention, the annulus 312 is sealed as described above, and the pressure and flow are diverted via flow line 218 to a four phase separator 220 below ground level, while maintaining the underbalanced condition. Excess pressure buildup can be controlled using the valve 222 to bleed off the pressure. This enables production while drilling without the damaging side effects of overproducing.

Figures 5A, 5B:
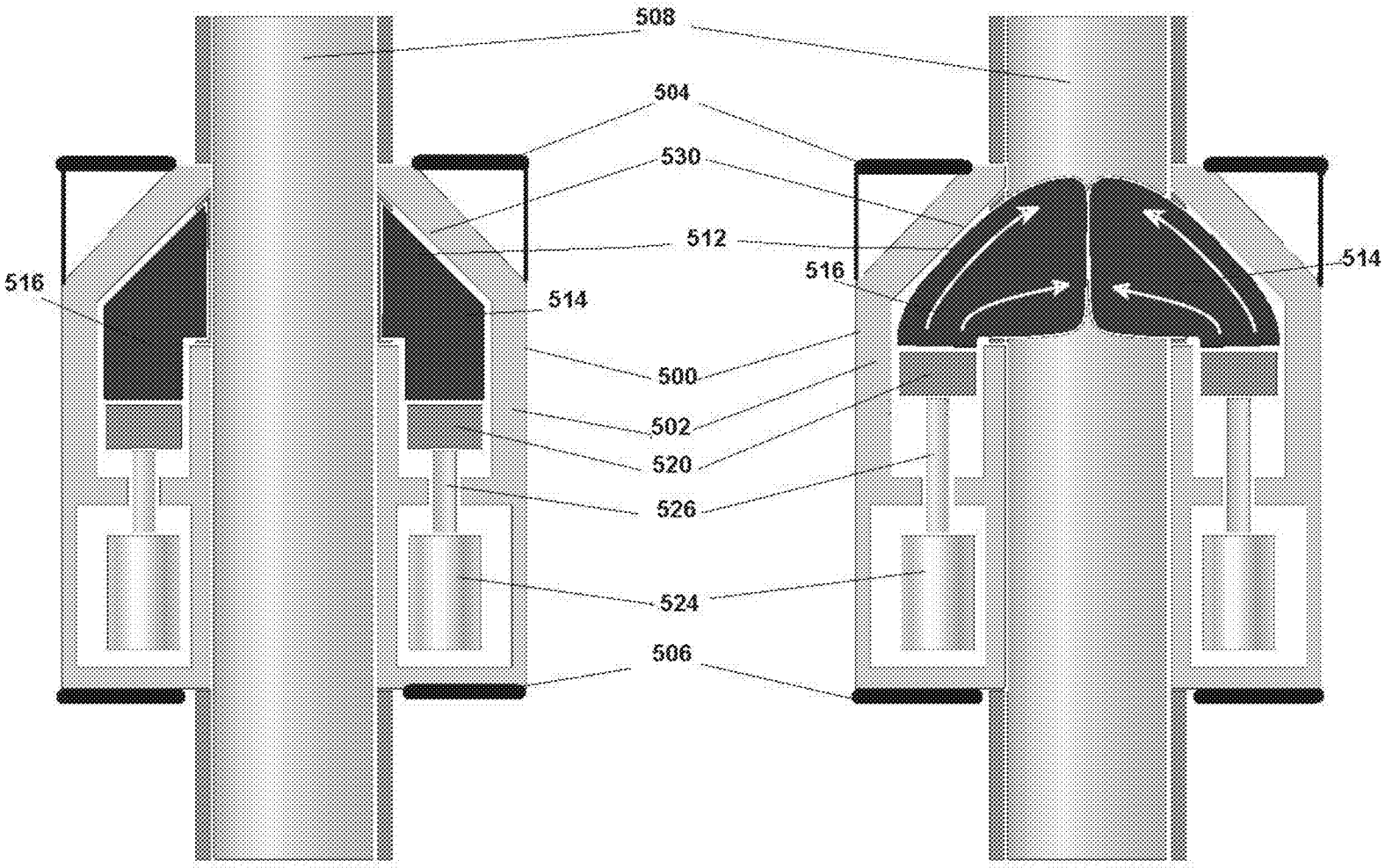
FIG. 5A shows a simplified drawing of an Annular Pressure Control Diverter of one embodiment when not activated.
FIG. 5B shows a simplified drawing of an Annular Pressure Control Diverter of one embodiment when activated during drilling operations.

FIGS. 5A and 5B show a conceptual representation of the Annular Pressure Control Diverter 500, simplified to show the principles on which it operates. FIG. 5A shows the device when it is not activated; FIG. 5B shows the device activated as it would be during drilling operations. The Annular Pressure Control Diverter 500 comprises a cylindrical housing 502, which may be metallic, capable of withstanding high pressures, up to 5,000 psi.

At the upper end of the cylindrical housing 502 is a flange 504. At the lower end of the cylindrical housing 502 is a flange 506. Flanges 504,506, have industry-standard dimensions and standard holes for fastening the body to other devices or the well casing. The internal diameter of each flange is large enough to permit the passing of drill pipe 508 through the cylindrical housing 502, while limiting the vertical motion of the internal components of the Annular Pressure Control Diverter.

The presence of the upper flange 504 distinguishes the Annular Pressure Control Diverter 500 from a conventional RCD. In previous approaches to underbalanced drilling, the RCD is positioned at the top of the BOP stack and therefore does not have an upper flange to allow more devices to be installed above it. Embodiments of the present invention are intended to have a conventional BOP stack installed above them, and therefore have both upper and lower flanges.

One critical component of any annular safety device is the seal. The seal is a flexible component which fits around the drill pipe and grips it, forming a barrier within the annulus around the drill pipe. This barrier prevents the fluids within the annulus from flowing upwards into the upper BOP stack. The high pressure in the well is completely contained below the seal. The pressure in the upper BOP stack is maintained at atmospheric pressure, thus removing the danger to the operators on the drilling floor.

In one embodiment of the present invention, the seal does not rotate, and therefore this device does not need the bearings used in conventional Rotating Control Devices. It is anticipated that the seal will wear during the course of the drilling operation. This is not an issue for several reasons. The wear will be minimal because the seal is made from polyurethane or similar materials, which have shown great resistance to wear, and to some extent, are self-lubricating. The device will only be activated when drilling into the reservoir. The Annular Pressure Control Diverter may also not be in place during the drilling of the vertical section of the well. Once drilling of the vertical section and the transition curve is complete, the conventional BOP stack is removed and replaced by the BOP stack which includes the Annular Pressure Control Diverter. In most cases drilling the lateral into the productive formation will only take a few days, and the seals will last long enough to accomplish the task.

The seal employed by some embodiments is constructed as two selectively engaging seal elements. The surfaces of the seal elements in contact with each other may be manufactured with a pattern of raised bumps or nubbins and corresponding depressions such that they interlock securely. When the two parts of the seal are assembled, they form a toroidal shape, having a center hole through which the drill pipe can pass. The Annular Pressure Control Diverter can accommodate different sizes of drill pipe by changing the seal elements. Given the properties of the polyurethane from which the elements are made, they can accommodate a reasonable range of drill pipe diameter sizes and pipe connection sizes without needing to be changed. Some embodiments of the seal elements can close the center hole even with no drill pipe present.

The cylindrical housing 502 contains a toroidal seal 512, which is split into two interlocking seal elements, 514 and 516, made of polyurethane. Polyurethane has properties which make it especially suitable for this application. That is, polyurethane is highly compressible and can regain its original shape when the compression is released. Polyurethane is also highly stretchable, extending in some cases to up to six times its normal dimension with the ability to quickly revert to its original shape. Polyurethane is also resistant to wear. Different types of polyurethane have varying resistance to high temperatures, so it is easy to obtain the right type for a given application. And, of course, polyurethane is not affected by oil and gas.

Seal elements 514 and 516 are supported on a circular lower spacer 520. At least one hydraulic cylinder 524 is arranged around the base of the circular lower spacer 520. When the pistons 526 of the hydraulic cylinders 524 are extended, they force the circular lower spacer 520 upwards, compressing the seal elements 514, 516 against the sloping surface 530 inside the cylindrical housing 502, and tightening the seal elements 514, 516 around the drill pipe 506, as shown in FIG. 5B.

It should be noted that FIG. 5A shows a two-dimensional cross-section through the Annular Pressure Control Diverter and that the seal elements 514, 516 are toroidal in shape. FIG. 5B also shows a two-dimensional cross-section, but the seal elements 514, 516 are drawn to show how they are compressed around the drill pipe 506.

In some embodiments, when the hydraulic pressure in the hydraulic cylinders 524 is lowered, the seal elements 514, 516 revert to their former shape, pushing down the pistons 526 and lower spacer 520. In other embodiments, dual-acting pistons are used so that the pistons 526 pull down the circular lower spacer 520, allowing the seal elements 514, 516 to revert to their former shape.

FIGS. 5A and 5B are intended to illustrate the principle of how an Annular Pressure Control Diverter might be used to block the annulus around the drill pipe and enable the return fluids to be diverted. For specifics on how this type of Annular Pressure Control Diverter operates and is constructed, see the '837 Application.

Figure 6:
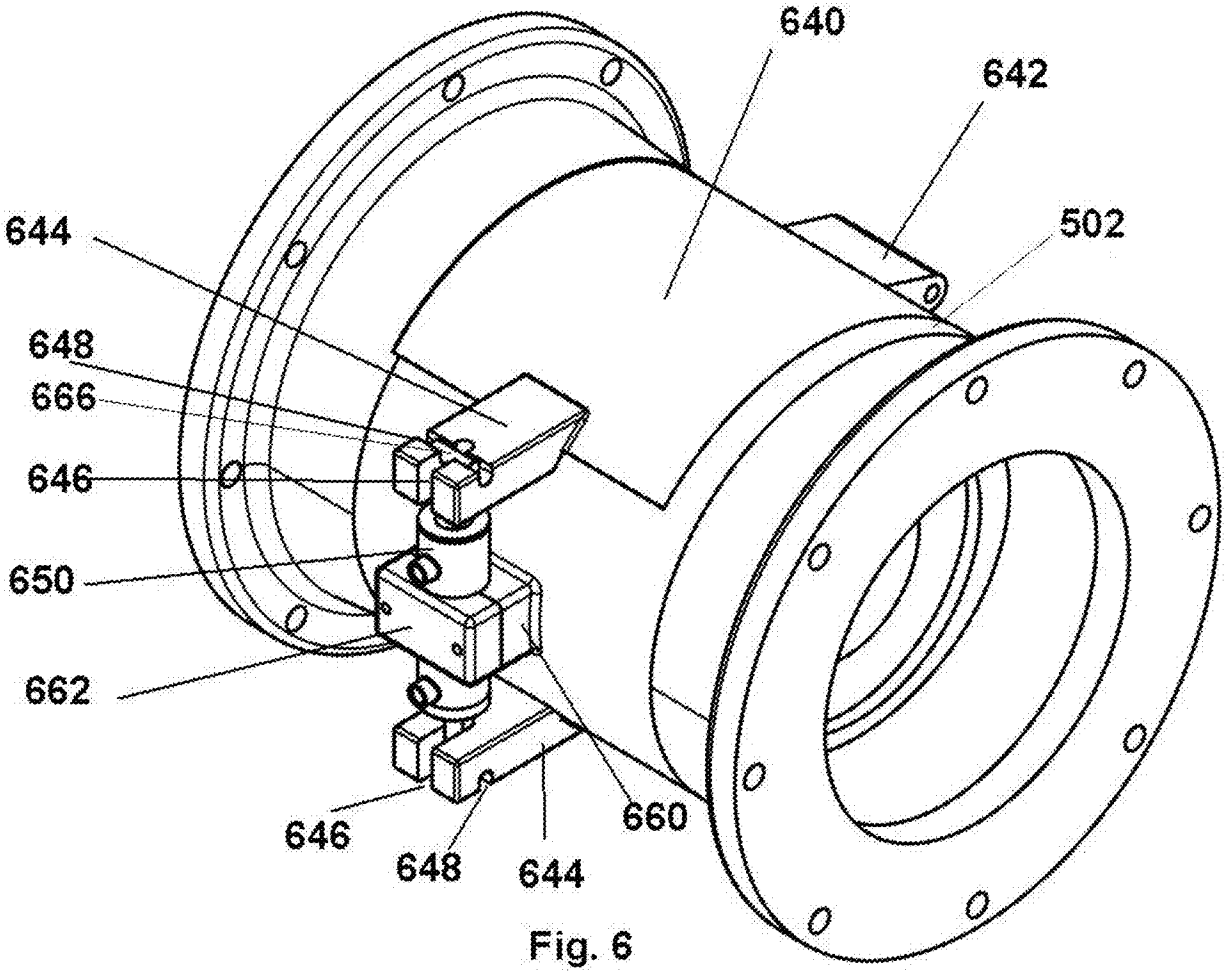
FIG. 6 shows a drawing of an Annular Pressure Control Diverter of one embodiment with side access doors locked by a dual acting hydraulic piston.

FIG. 6 shows one embodiment of an Annular Pressure Control Diverter equipped with side doors. Each door 640 is equipped with hinges 642 on one side. On the other side of the door is a first projection 644 with a horizontal slot 646 and a vertical groove 648. A dual-acting hydraulic cylinder 650 is mounted on a raised section projection 660 of the cylindrical housing 502 and is held in position by a clamp 662. The clamp 662 is bolted to the raised section projection 660 of the cylindrical housing 502, and may be removed so that the hydraulic cylinder 650 can be replaced or removed for inspection and maintenance.

At each end of the pistons 664 of the hydraulic cylinder 650 is a metal T-bar 666. When the dual hydraulic cylinders 650 are not pressurized, these T-bars 666 are horizontal. As the dual cylinders 650 are pressurized, the pistons 664 extend, and the T-bar 666 passes through the horizontal slot 646 in the first projection 644. As the pistons 664 reach the end of their travel, they rotate ninety degrees and retract slightly so that the T-bar 666 fits into the vertical groove 648 on the first projection 644 on the door 640, thus locking the doors 640 together as shown in FIG. 6. The pressure in the hydraulic cylinders 650 can be reduced and the doors 640 will remain locked together. As a safety feature, even if the hydraulic pressure was reduced to zero, or the hydraulic system failed for any reason, the doors 640 would remain locked together. To open the doors 640, the hydraulic system must be pressurized fully to extend the pistons 664 to their maximum extent, pushing the T-bars 666 out of the vertical groove 648 so that they can be rotated to a horizontal position, and then withdrawing the T-bars 666 through the horizontal slot 646.

FIGS. 5A, 5B and 6 show a device which operates as an annular device, not as a ram device. The objective of blocking the annulus could, as previously stated, also be achieved with a ram device. The embodiment of the Annular Pressure Control Diverter shown in FIGS. 5A, 5B and 6 is an example of an active diverter, in that it uses hydraulic pistons to energize the seals. Alternative embodiments are possible, such as a passive diverter which uses formation pressure acting on a tapered seal to squeeze the seal around the drill pipe.

The above description provides just some example of how the devices, casings, and pipes may be configured, and additional casings may be installed in some drilling operations. Some drilling operations may be required to install additional casing, add cementing, or make other changes to meet local regulations. Additional safety valves, BOPs, RCDs, pipe rams, blind rams and shear rams may also be installed to meet the needs of the drilling operation, company policies, and any applicable safety regulations.

It is also noted that many of the structures, materials, and acts recited herein can be recited as means for performing a function or step for performing a function. Therefore, it should be understood that such language is entitled to cover all such structures, materials, or acts disclosed within this specification and their equivalents, including any matter incorporated by reference.

It is thought that the apparatuses and methods of embodiments described herein will be understood from this specification. While the above description is a complete description of some specific embodiments, the above description should not be taken as limiting the scope of the patent as defined by the claims.

Although the above description includes many specific examples, they should not be construed as limiting the scope of the invention, but rather as merely providing illustrations of some of the many possible embodiments of this method. The scope of the invention should be determined by the appended claims and their legal equivalents, and not by the examples given.

Other aspects, advantages, and modifications will be apparent to those of ordinary skill in the art to which the claims pertain. The elements and use of the above-described embodiments can be rearranged and combined in manners other than specifically described above, with any and all permutations within the scope of the disclosure.

What is claimed is:

1. A method for drilling an oil or gas well using a mechanical primary pressure control mechanism, comprising:

providing a tubing head;

interconnecting a production casing head to the tubing head;

interconnecting a casing head to the production casing head;

interconnecting a production casing on a first end to the production casing head and to a second end to a bottom hole drilling assembly;

interconnecting an intermediate casing to the casing head, wherein the intermediate casing is positioned about the production casing to provide an outer annulus, the intermediate casing also interconnected to the production casing with a liner hanger and interconnecting an inner tubing string configured to transport drilling fluid on a first end to an annular pressure control diverter and to a second end to the bottom hole drilling assembly, wherein portions of the inner tubing string extends through the tubing head, the production casing head, and the casing head and wherein the inner tubing string is positioned within the production casing to define an inner annulus and wherein the annular pressure control diverter is the mechanical primary pressure control mechanism of the oil and gas well.

2. The method of claim 1, further comprising a blowout preventer equipment stack as an emergency pressure control device above the annular pressure control diverter.

3. The method of claim 1, wherein the Annular Pressure Control Diverter is a non-rotating annular control device.

4. The method of claim 1, wherein the Annular Pressure Control Diverter is a Rotating Control Device.

5. The method of claim 1, wherein the Annular Pressure Control Diverter is an annular blowout preventer.

6. The method of claim 1, wherein the Annular Pressure Control Diverter is a pipe ram blowout preventer.

7. The method of claim 1, further comprising installing an annular blowout preventer below the Annular Pressure Control Diverter.

8. The method of claim 1, further comprising installing a pipe ram below the Annular Pressure Control Diverter.

9. The method of claim 1, wherein the production casing is ported above a lower extremity of the intermediate casing to enable fluid flow from the inner annulus, into the outer annulus, into the casing head, and to a separator;

blocking the inner annulus using the Annular Pressure Control Diverter to create a return flow pattern where no drilling fluid and produced fluids return up the inner annulus; and wherein drilling fluid and produced fluids return up the outer annulus.

10. A method for drilling an oil or gas well having a return flow pattern where no fluids return up an annulus between an inner tubing string and a production casing, wherein drilling fluid alternatively returns up an annulus between the production casing and an intermediate casing, comprising:

installing a blowout preventer, the blowout preventer being in fluidic communication with the casing head;

installing the intermediate casing to a casing head;

installing a flow line from the casing head to a production separator;

installing the production casing concentric with and inside the intermediate casing;

installing the inner tubing string concentric and inside the production casing;

wherein the production casing is ported above a lower extremity of the intermediate casing to enable the return flow of fluids from the annulus between the inner tubing string and the production casing, into the annulus between the production casing and the intermediate casing, to the casing head, and to the separator; and installing an Annular Pressure Control Diverter as a mechanical primary pressure control mechanism between the blowout preventer and the casing head, the Annular Pressure Control Diverter configured to selectively block the annulus between the inner tubing string and the production casing to create a return flow pattern where no drilling fluid and produced fluids return up the annulus between the inner tubing string and the production casing and instead drilling fluid and produced fluids return up the annulus between the production casing and the intermediate casing.

11. The method of claim 10, further comprising installing an annular blowout preventer below the Annular Pressure Control Diverter.

12. The method of claim 10, further comprising installing a pipe ram below the Annular Pressure Control Diverter.

13. A method for drilling an oil or gas well wherein drilling fluid returns are flowed through a well head located below an all-inclusive blowout preventer stack to a drilling choke, comprising:

installing an intermediate casing attached to a casing head;

installing a production casing concentric with and inside the intermediate casing;

installing a flow line from a production casing head to a separator;

inserting an inner tubing string concentric with and inside the production casing;

wherein the production casing is ported above a lower extremity of the intermediate casing to enable the return flow of fluids from an annulus between the inner tubing string and the production casing into an annulus between the production casing and the intermediate casing, to the production casing head, and to the drilling choke and installing an Annular Pressure Control Diverter as a mechanical primary pressure control mechanism below the blowout preventer stack, the Annular Pressure Control Diverter configured to selectively block the annulus between the inner tubing string and the production casing.

14. The method of claim 13, further comprising installing an annular blowout preventer below the Annular Pressure Control Diverter.

15. The method of claim 13, further comprising installing a pipe ram below the Annular Pressure Control Diverter.

* * * * *